US005139390A

United States Patent [19]

Rajewski

[11] Patent Number: 5,139,390

[45] Date of Patent: Aug. 18, 1992

[54] PUMP AND METHOD FOR DRAWING VAPOR FROM A STORAGE TANK WITHOUT FORCIBLY DRAWING THE VAPOR FROM THE TANK

[76] Inventor: Robert K. Rajewski, P.O. Box 2247, Stettler, Alberta, Canada, T0C 2L0

[21] Appl. No.: 649,981

[22] Filed: Feb. 4, 1991

[51] Int. Cl.[5] ..... F04B 45/00

[52] U.S. Cl. ..... 417/53; 417/398; 417/478; 137/589

[58] Field of Search ..... 417/375, 398, 403, 472, 417/478, 479, 53; 137/587, 589; 431/202

[56] References Cited

U.S. PATENT DOCUMENTS 334,571 1/1886 De Logerot ..... 417/478 X
665,992 1/1901 Burgess ..... 417/398
2,855,144 10/1958 Andreasen ..... 417/398
2,912,791 11/1959 Cohen ..... 417/478 X
3,014,231 12/1961 Ziegler ..... 417/398
3,349,716 10/1967 Weber ..... 417/478
4,087,228 5/1978 Datis ..... 431/202
4,187,845 2/1980 Dror ..... 128/205.13

*Primary Examiner*—Leonard E. Smith
*Attorney, Agent, or Firm*—Anthony R. Lambert

[57] ABSTRACT

A vapor transfer pump for a storage tank includes a bladder and a continuously reciprocating plate disposed about the bladder. Vapor from the storage tank enters the bladder through a one way check valve set at a low pressure, and is forced out, by the continuously reciprocating plate, through a second one way check valve set at a higher pressure.

4 Claims, 3 Drawing Sheets

PUMP AND METHOD FOR DRAWING VAPOR FROM A STORAGE TANK WITHOUT FORCIBLY DRAWING THE VAPOR FROM THE TANK

FIELD OF THE INVENTION

This invention relates to pumps, valves and the like for the transfer of vapour away from stored flammable materials and the like.

BACKGROUND AND SUMMARY OF THE INVENTION

When oil or other flammable materials are stored in liquid form, as for example in well head production tanks, vapour from the oil or from gases entrapped with the oil often escapes the oil and may be released into the atmosphere from the storage tank where it can be easily ignited or cause an environmental danger due to its toxicity. It is therefore desirable to pump the vapour away from the oil storage area and burn it in a controlled manner at a flare stack.

The inventor has found that drawing vapour from the oil storage tank can create a dangerous condition by drawing air into the storage tank from the atmosphere. This occurs if, in pumping the vapour from the storage tank, a vacuum is created in the outlet line from the oil storage tank.

The inventor has therefore provided a device that places constant pressure on the storage tank while allowing vapour to be pumped out of the storage tank.

Therefore in one aspect of the invention, the inventor has provided a vapour transfer pump for a storage tank comprising:

an inlet line connected to the storage tank;

a first one way check valve on the inlet line;

an expandable container connected to the inlet line;

first means disposed about the expandable container and reciprocable independently of the expandable container for forcing vapour out of the expandable container;

second means to reciprocate the first means about the expandable container;

an outlet line connected to the expandable container and connectable to a flare stack; and a second one way check valve on the outlet line.

In a preferred embodiment, the expandable container is a bladder, and the first means is formed from a stationary plate and a reciprocating plate, the bladder being disposed between the stationary plate and the reciprocating plate.

BRIEF DESCRIPTION OF THE DRAWINGS

There will now be described a preferred embodiment of the invention, with reference to the figures, by way of illustration, in which like numerals denote like elements and in which.

DETAILED DESCRIPTION OF PREFERRED EMBODIMENTS

Figure 1:
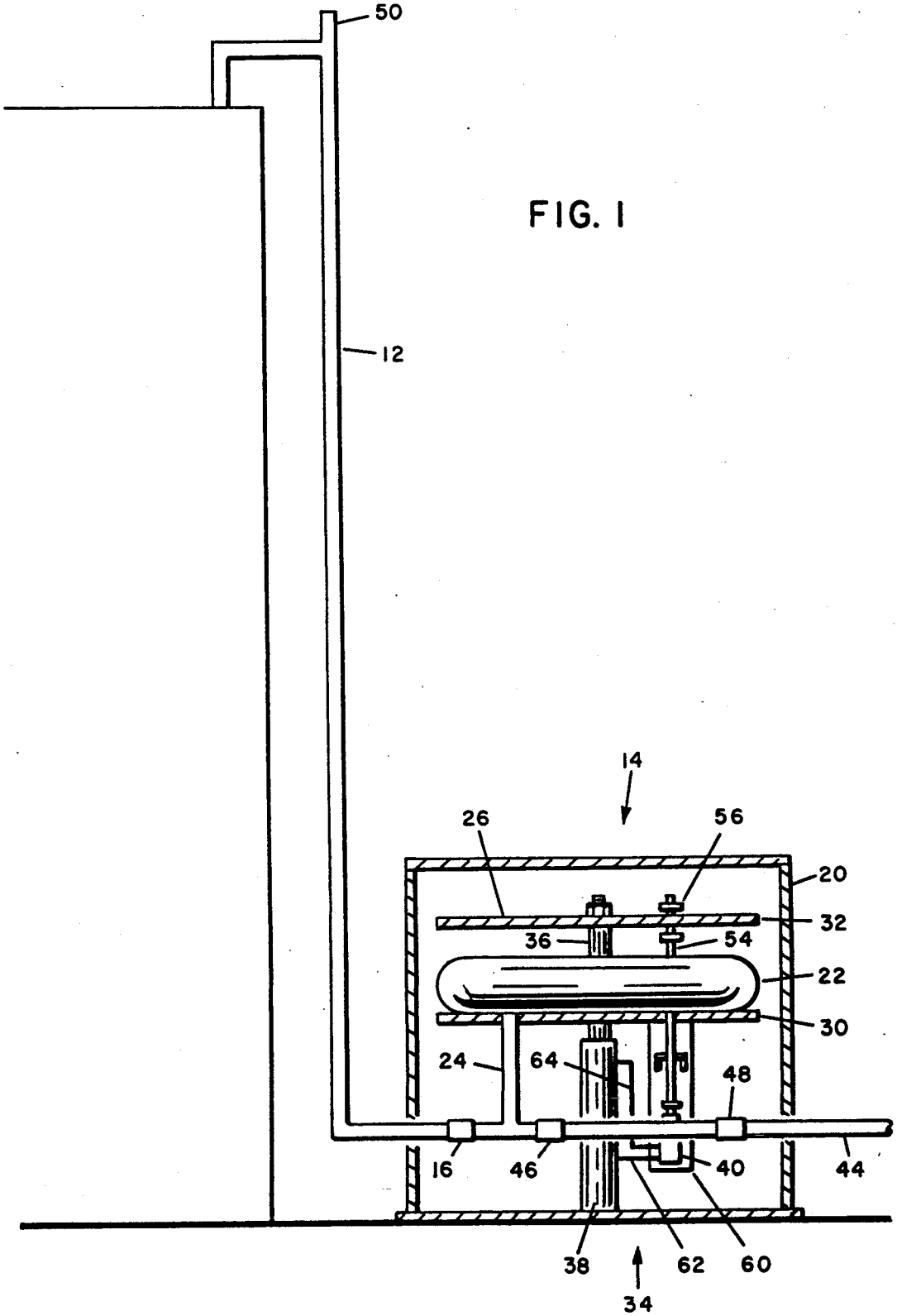
FIG. 1 is a side view schematic of a preferred embodiment of the invention.

FIG. 1 shows a production tank 10 with line 12 attached to it for venting gases or vapour from the tank.

Typically at a production well head this tank will contain oil. Line 12 runs out to the vapour transfer pump generally designated 14 where it constitutes an inlet line for the vapour transfer pump. A first one way check valve 16 preferably of the flapper type which operates one way under minimal pressure is placed on the inlet line.

The vapour transfer pump 14 is contained in a pump housing 20, which is preferably made of steel and is heated in conventional manner to provide protection to and warm operating conditions for the pump. The vapour transfer pump 14 includes an expandable container 22, preferably a rubber bladder (in the form of a torus), connected to the inlet line 12 through connection line 24. The expandable container 22 is disposed within a first means 26 which is reciprocable independently of the expandable container 22 for forcing vapour out of the expandable container 22, under reciprocal movement created by a second means 34, including hydraulics, to be described in more detail below.

An outlet line 44 is connected to the expandable container 22 through connection line 24. The outlet line 44 is connectable to a flare stack (not shown, but well known in the art). A second one way check valve 46 on the outlet line 44, also preferably a flapper valve, allows outflow of vapour to the flare stack but resists back flow of gas. A further high pressure check valve 48 is desirable on the outlet line to prevent over pressure conditions. Preferably this valve 48 should have a rating of at least 100 lbs. Methanol may be injected into the inlet line 12 at 50 to prevent freeze up.

While the inlet line 12 and outlet line 44 have been shown entering and exiting the housing 20 at opposite sides, it is preferable that they enter and exit from the same side, adjacent each other, with the valves 16 and 46 just inside the housing. In this way, the lines 12 and 44 can be easily detached from the valves 16 and 46, leaving the pump components as a unit that can be easily removed from the housing, for example on tracks, not shown, for maintenance.

Figure 2:
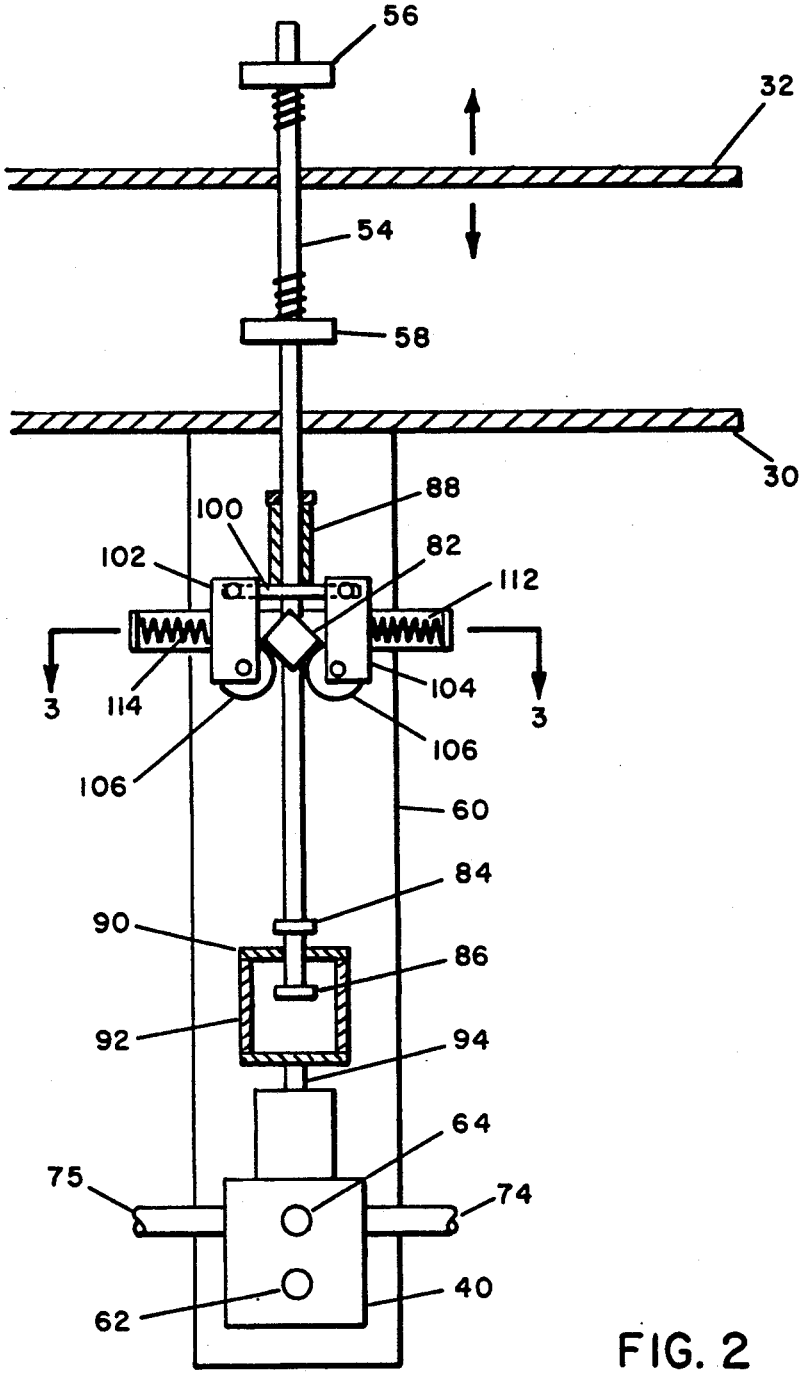
FIG. 2 is a side view schematic of a trip system for the apparatus of FIG. 1.
Figure 3:
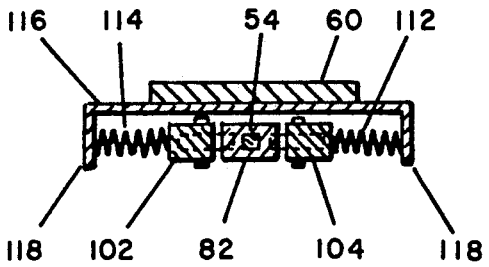
FIG. 3 is a section along line 3—3 in FIG. 2.

In the preferred embodiment, the first means 26 is formed from a stationary plate 30 and a reciprocating plate 32, the expandable container being disposed between the stationary plate 30 and the reciprocating plate 32. The reciprocating plate 32 is reciprocated by a second means 34 which consists of a shaft or piston rod 36, double acting hydraulic cylinder 38, connecting hoses 62 and 64, valve 40 with rod 54 and trip system including stops 56 and 58 (see FIGS. 2 and 3) on support 60 and hydraulic system with motor 70 (see FIG. 4). The motor drives a hydraulic pump 72 (see FIG. 4) that supplies hydraulic fluid to the valve 40. Valve 40 directs the flow of hydraulic fluid to either side of the double acting hydraulic cylinder 38 through hoses 62 and 64, one on each end of the hydraulic cylinder. Double acting hydraulic cylinders are well known in the art so the operation of the cylinder to give reciprocal motion will be described here only briefly with reference to FIGS. 2 and 3.

The shaft or piston rod 36 extends from the double acting hydraulic cylinder through a hole in the stationary plate 30, through the central part of the toroidal bladder 22 and attaches to the reciprocating plate 32. The rod 54 extends up through both the reciprocating plate 32 and the stationary plate 30. The reciprocating plate 32 moves up and down as indicated by the arrows in FIG. 2 with the movement of the shaft 36. The first stop 56 (shown on the rod 54) is set near the upper limit of movement of the reciprocating plate 32. The second stop 58 is placed on the rod 54 at a point near the stationary plate 30 and corresponds to a suitably compressed point of the bladder 22. The run of the plate 32 depends on the length of the hydraulic cylinder. The rod 54 is free moving within a sleeve 80 attached to the support 60, for example by bolting or welding. The support 60 itself is attached to the plate 30. At a central point on the rod 54 there is secured a cam 82 with upper and lower sloping surfaces. At the lower end of the rod 54 is a pair of nuts or stops 84 and 86, one on each side of the upper plate 90 of a box 92. The lower end of the box 92 is secured to the control switch 94 on the valve 40. The valve 40 is preferably a spool valve. Attached to the support 60 at a central point is a bar 100 having pivotally attached to its extremities a pair of swinging arms 102 and 104. At the respective extremities of each of the swinging arms 102 and 104 there is a roller 106. The swinging arms 102 and 104 abut against compression springs 114 and 112 respectively, themselves secured in frame 116 having angle ends 118 against which the compression springs 112 and 114 abut.

The manner of operation of the trip system is as follows. Assuming we start with the reciprocating plate 32 travelling downward under hydraulic pressure in the cylinder 38 (as shown as the position in FIG. 2), hydraulic fluid will be flowing into the cylinder in hose 64 and out through hose 62. When the reciprocating plate 32 reaches its downward limit, it comes up against the stop 58 and forces the rod 54 and cam 82 downward so that the cam moves between the sprung rollers 106. This compresses the springs 112 and 114, which, as the rollers 106 roll down the lower edge of the cam 82, force the rod 54 downward until stop 84 hits plate 90 and thus switch 94, which signals the valve 40 to switch the direction of flow in the hoses. Hydraulic fluid then flows into the cylinder 38 in hose 62 and out through hose 64. This reverses the direction of movement of the shaft 36, hence of plate 32. Plate 32 then travels upward until it meets stop 56, which then moves upward with plate 32 until the cam 82 clears the rollers 106. As the cam 82 clears the rollers 106, compressing the springs 114 and 112, the return force of the compressed springs forces the rod 54 quickly down the upward slope of the cam 82, such that the stop 86 is forced up against the plate 90, thus switching the switch 94 on the valve 40. This again reverses the direction of flow in the hoses 62 and 64, and thus the direction of movement of the shaft 36 and plate 32, which returns to the position shown in FIG. 2. Thus the valve 40 and hydraulic cylinder 38 automatically reverse the direction of the movement of the shaft 34 to reciprocate the first means 26 about the expandable container 22.

Figure 4:
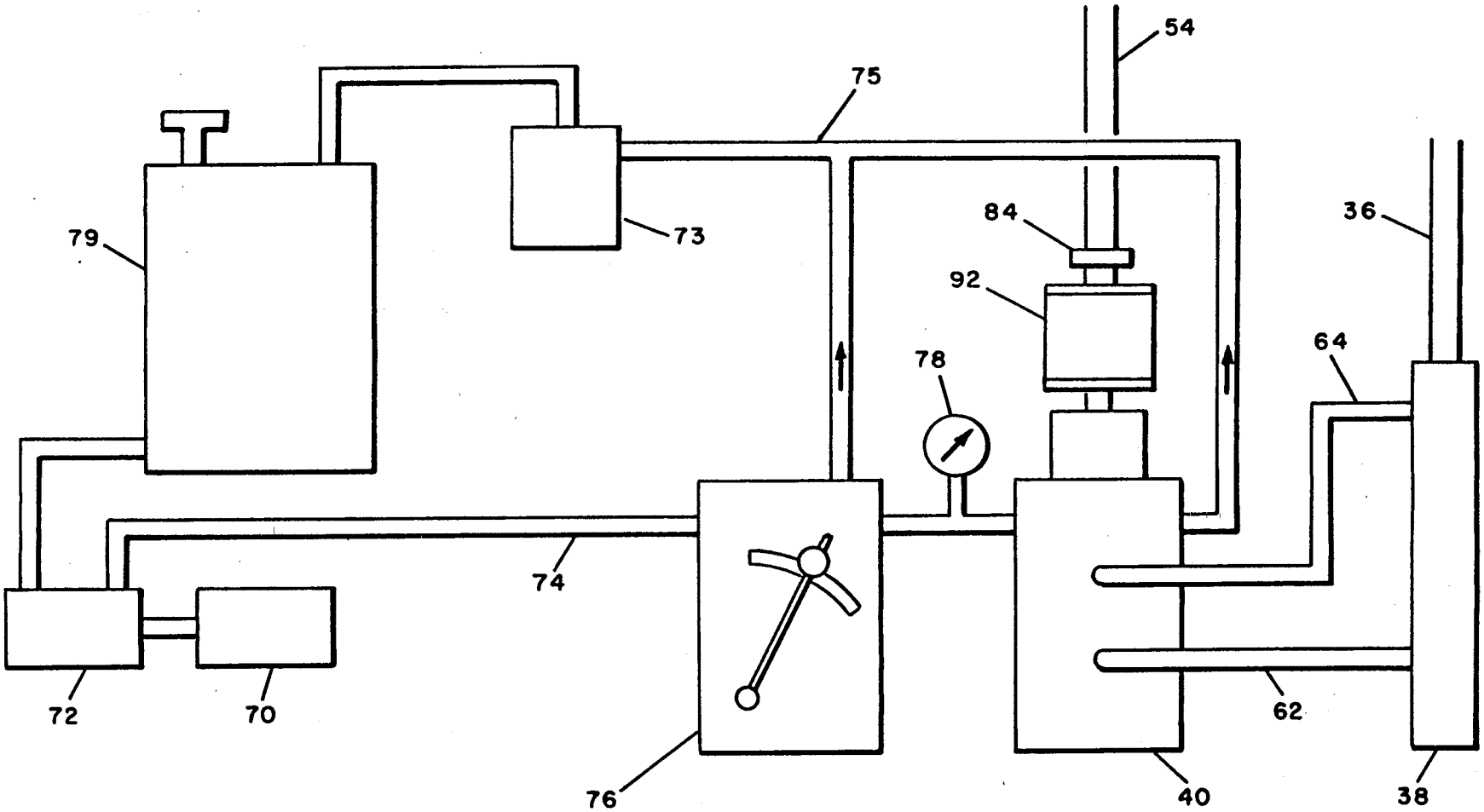
FIG. 4 is a schematic of the power system for the apparatus of FIG. 1.

The hydraulic system is shown in FIG. 4. Motor 70 is electrically powered in known fashion and drives hydraulic pump 72. Flow from the pump 72 passes down hose 74 through speed control 76 and gauge 78 to valve 40. The spool valve 40 preferably incorporates a bypass valve set at 3 lbs pressure so that if the hydraulics build up such a pressure level, then the reciprocating plate 32 can be set to idle until the pressure level is reduced, thus avoiding dangerous over pressure conditions in the hydraulics in the second means and bladder. Hoses 62 and 64 feed the hydraulic cylinder 38. Return flow is through hoses 75 and 77, and passes through conventional filter 73 and reservoir 79. The motor itself may be for example an onsite electric motor or if the oil well has one, a pump jack.

The manner of operation of the vapour transfer pump is as follows. Vapour from the storage tank over a minimal pressure, less than ½ ounce, passes through the inlet line 12 and check valve 16 under pressure from pressure in the production storage tank into the bladder 22. The bladder then continuously fills up with vapour, absent other pressures on it. The reciprocating plate 32 moves up and down continuously independently of the bladder 22 under power from the second means 34. On the up stroke of the reciprocating plate 32, the bladder 22 fills with vapour, and on the down stroke the vapour is forced out of the bladder 22 out through the outlet line 44, second check valve 46 and high pressure valve 48 to the flare stack. In this manner, the tank may be evacuated and vapour forced out to a flare stack without putting a vacuum on the tank.

Alternative Embodiments

A person skilled in the art could make immaterial modifications to the invention described and claimed in this patent without departing from the essence of the invention.

I claim:

1. A method of removing vapour from a storage tank, with a reciprocating pump and an expandable container, comprising the steps of:

filling the expandable container through an inlet line connected to the container with vapour under pressure from the storage tank; and forcing the vapour out of the expandable container through an outlet line with the reciprocating pump, whereby vapour is transferred from the storage tank without forcibly drawing vapour from the storage tank.

2. A vapour transfer pump for a storage tank, the storage tank containing flammable materials and having a vapour pressure, the pump comprising:

an inlet line connected to the storage tank;

a first one way check valve on the inlet line;

an expandable container connected to the inlet line, the container being expandable by the pressure from the storage tank;

first means disposed about the expandable container and reciprocable independently of the expandable container for forcing vapour out of the expandable container;

second means to reciprocate the first means about the expandable container;

an outlet line connected to the expandable container and connectable to a flare stack; and a second one way check valve on the outlet line, whereby vapour is transferred from the storage tank without being forcibly drawn from the storage tank.

3. The vapour transfer pump of claim 2 in which the expandable container is a bladder.

4. The vapour transfer pump of claim 3 in which the first means is formed from a stationary plate and a reciprocating plate, the bladder being disposed between the stationary plate and the reciprocating plate.

* * * * *